United States Patent [19]

Nonomaque et al.

[11] 3,944,111

[45] Mar. 16, 1976

[54] FREEZER LINER CONSTRUCTION

[75] Inventors: Clyde Joseph Nonomaque, Fort Smith, Ark.; Harry Lucian Tillman; Kenneth L. Hortin, both of Evansville, Ind.

[73] Assignee: Whirlpool Corporation, Benton Harbor, Mich.

[22] Filed: Nov. 4, 1974

[21] Appl. No.: 520,642

[52] U.S. Cl. ..... 220/63 R; 156/79; 220/9 F; 220/9 G; 264/46.5

[51] Int. Cl.[2]B65D 87/34; F25D 23/06; F25D 23/08

[58] Field of Search ..... 220/9 F, 9 G, 10, 63 R, 220/65; 312/214; 156/77, 78, 79; 264/46.5

[56] References Cited

UNITED STATES PATENTS

| | | | |
|---|---|---|---|
| 3,013,922 | 12/1961 | Fisher | 220/9 F X |
| 3,078,003 | 2/1963 | Kesling | 220/9 F |
| 3,150,796 | 9/1964 | Hocking et al. | 220/9 F |
| 3,240,029 | 3/1966 | Wurtz | 220/9 G X |
| 3,294,462 | 12/1966 | Kesling | 220/9 F X |
| 3,440,308 | 4/1969 | Carbary et al. | 264/46.5 X |
| 3,563,845 | 2/1971 | Stevens | 264/46.5 X |
| 3,719,303 | 3/1973 | Kronenberger | 220/9 F |
| 3,722,538 | 3/1973 | Gezari | 220/9 F X |
| 3,782,798 | 1/1974 | Whorton | 220/9 F X |
| 3,813,137 | 5/1974 | Fellwock et al. | 220/9 G X |

*Primary Examiner*—William Price
*Assistant Examiner*—Stephen Marcus
*Attorney, Agent, or Firm*—Wegner, Stellman, McCord, Wiles & Wood

[57] ABSTRACT

A freezer liner construction having improved selected foam adhesion characteristics. The outer surface of the liner is provided with a laminated release film which prevents adhesion of the foamed-in-place insulation thereto for optimum stress relief relative to thermal expansion and contraction of the liner relative to the foam and cabinet. One or more adhesion strips are provided on the release laminate to provide localized bonding of the foam to the liner for improved structural integrity in the cabinet structure.

15 Claims, 4 Drawing Figures

FREEZER LINER CONSTRUCTION

BACKGROUND OF THE INVENTION

1. Field of the Invention

This invention relates to cabinet constructions and in particular to refrigeration appliance cabinet constructions having plastic liners and foamed-in-place insulation.

2. Description of the Prior Art

In one conventional refrigeration appliance cabinet construction, a plastic liner is inserted in spaced relationship to an outer metal cabinet shell and insulation is foamed-in-place therebetween. Conventionally, the insulation comprises polyurethane material which tends to bond strongly to the outer surface of the plastic liner.

It has been found that in conventional use of such refrigeration appliances, thermal expansion and contraction occurs as a result of variations in the ambient and refrigerated temperatures. Cracking of the liner has, at times, resulted because of the differential thermal expansion characteristics of the cabinet materials. One improved form of such a refrigeration appliance cabinet construction utilizes selected foam release means at different stress points in the cabinet construction to permit movement between the foam and plastic liner materials thereat to prevent such cracking.

In another form of improved refrigeration appliance cabinet construction, the entire outer surface of the liner is provided with a foam release laminate. The laminate is formed of deformable material so that it may be adhered to the plastic material prior to the thermoforming of the plastic material into the liner configuration. Thus, this improved liner construction provides a low cost arrangement effectively eliminating the cracking problem while yet permitting the use of conventional liner plastic materials and foam insulation materials.

It has been found, however, that some adhesion between the foam insulation and the liner is desirable in selected areas in providing improved structural integrity and rigidity to the liner and cabinet construction.

In one form of refrigerator cabinet construction, as shown in U.S. Pat. No. 3,078,033 of Keith K. Kesling, a thin sheet of material is applied over the formed liner to prevent adhesion of the polyurethane foam thereto. Colin S. Hocking et al. U.S. Pat. No. 3,150,796 shows a similar sheet, which is removable from the liner to which the foamed insulation adheres. In Keith K. Kesling U.S. Pat. No. 3,294,662, a refrigerating apparatus is shown utilizing a parting agent on the surfaces of the liner adjacent selected portions thereof to prevent adhesion of the foam insulation to the liner thereat.

In Paul E. Kronenberger U.S. Pat. No. 3,719,303, a foam release agent is applied to the inner surface of the cabinet shell to accommodate the thermal expansion coefficient differentials.

SUMMARY OF THE INVENTION

The present invention comprehends an improved liner construction for use in a refrigeration appliance cabinet wherein a foam release laminate is provided on the sheet material from which the liner is formed. At selected positions on the laminate material, bodies of foam adherent material are secured so as to provide a structural bondment between the foamed insulation and the liner at the selected positions.

In the illustrated embodiment, the foam bonding material comprises strips of foam adherent material secured to the outer surface of the foam release laminate.

Illustratively, the foam adherent strips may be provided vertically along the front edges of side walls of the liner. Similarly, the foam adhesion material may comprise a strip extending rearwardly from adjacent the front edge of the top wall of the liner.

The adhesive strips may be formed of foam material, such as polyurethane, polypropylene, etc., foam. The strips may be adhesive-backed. The adhesive back surface may be flat or striated, as desired.

In the illustrated embodiment, the strips have a thickness of approximately one-sixteenth to one-eighth inch.

The strips may be provided as cut sheet strips or continuous length rolled strips.

Alternatively, the adhesive material may comprise masking-type tapes adhesively secured to the liner laminate.

Adhesive backed foam strips have the ability, when foamed in place with polyurethane insulation, to allow for a slight degree of movement of the liner under a stressed condition thereby holding the liner with a slightly flexible grip thus preventing a severe stress build-up.

The adhesive means may have a relatively low durometer so as to tear apart in the event it is desired to remove the liner from the cabinet construction while yet providing desired structural integrity to the cabinet in normal use.

Thus, the present invention comprehends an improved low cost liner construction providing improved crack resistance and structural integrity.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
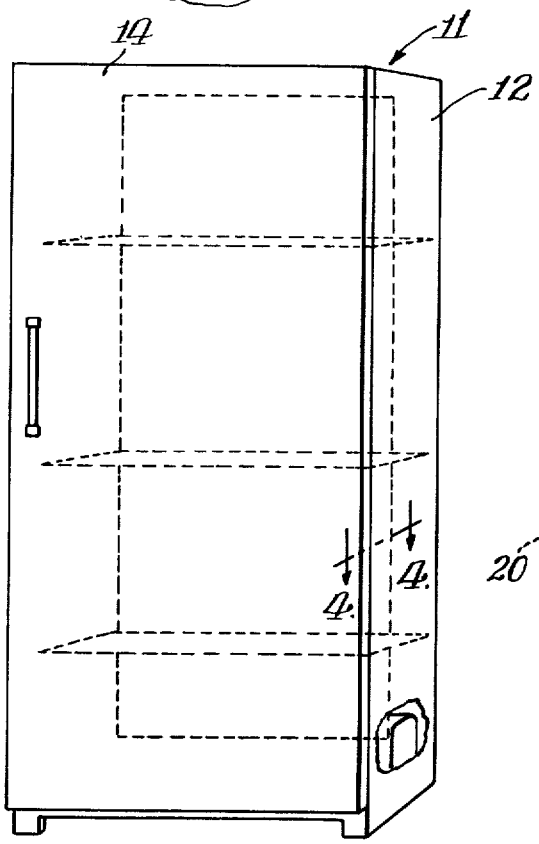
FIG. 1 is a front perspective view of a refrigeration appliance embodying the invention.

In the exemplary embodiment of the invention as disclosed in the drawing, a liner construction generally designated 10 is shown for use in a refrigeration appliance illustratively comprising an upright freezer 11 having a cabinet 12 defining an inner refrigerated space 13 selectively accessible by means of a front door 14. Space 13 is effectively defined by the inner liner generally designated 15 of cabinet 12 which may be formed of a thermoformable rigid plastic.

Figure 3:
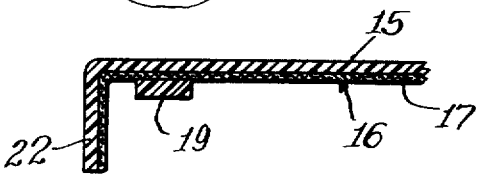
FIG. 3 is an enlarged fragmentary horizontal section taken substantially along the line 3—3 of FIG. 2.
Figure 4:
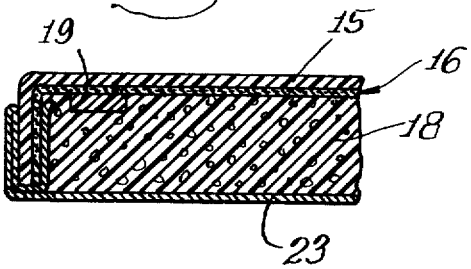
FIG. 4 is an enlarged fragmentary horizontal section taken substantially along the line 4—4 of FIG. 1.

As shown in FIG. 3, the plastic liner 15 is provided on its outer surface with a laminate 16 having an outermost foam release layer 17. The liner laminate foam release material may comprise a polyethylene laminate such as disclosed in copending application Ser. No. 502,006, of Leonard E. Weiss et al., filed Aug. 30, 1974, entitled "Liner Construction". The laminate is bonded to the outer surface of the plastic liner 15 and effectively covers the entire surface for preventing adhesion to the plastic liner of the insulation 18 which may comprise foamed-in-place polyurethane material.

More specifically, outer surface portion 17 of laminate 16 is formed of a material adapted to be free of adhesion with the foamed-in-place insulation thereby permitting movement between the plastic liner 15 and the insulation to prevent undesirable stressing and cracking of the liner as a result of differential thermal expansion characteristics of the liner and foam materials. Illustratively, outer surface portion 17 of the laminate may be formed of polyethylene. The laminate may be applied to the sheet material from which the liner is thermoformed prior to the thermoforming of the liner into the configuration shown in FIG. 2 as the laminate is flexible and is adapted to accommodate such a thermoforming operation while remaining adhered securely to the outer surface of the liner plastic 15.

Figure 2:
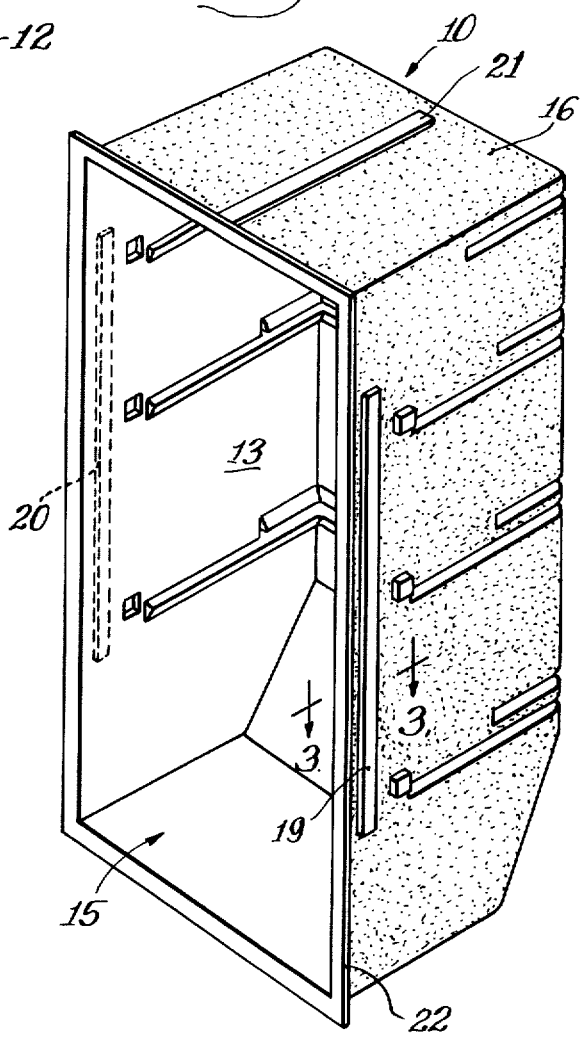
FIG. 2 is a perspective view of the liner construction thereof.

As further illustrated in FIGS. 2 and 3, the liner construction includes a plurality of foam adhesion elements illustratively comprising strips 19, 20 and 21 bonded to the outer portion 17 of the release laminate 16. The adhesion elements are located suitably to provide structural integrity in the cabinet construction by firmly securing the foam insulation to the plastic liner 15 in the preselected areas.

The adhesion elements may be formed of a suitable material, such as open-cell polyurethane flexible foam, foamed polypropylene, masking-type tape, etc.

More specifically, in one embodiment, the release elements were formed of two-pound density polyurethane open-cell foam adhesively backed to bond with the laminate portion 17. The strips were cut to approximately 2 inch widths and had a thickness of approximately one-eighth inch. Strips 19 and 20 were provided with a length of approximately 30 inches and were located approximately 1½ inch behind the front flange of the liner. The strip 21 had a length of approximately 22 inches and extended from directly behind the flange to adjacent the rear of the liner along the vertical center plane of the liner.

In another embodiment, the strips were formed of flexible polypropylene closed-cell foam having a density of 0.7 lbs. The strips were adhesively backed with a striated surface and had a thickness of approximately one-sixteenth inch. The strips were provided in the form of a single width roll having a length of approximately 200 feet for facilitating cutting to length.

The outer cabinet shell 23 may be formed of conventional material, such as metal, with the foam plastic adhering thereto, as suitable movement of the plastic liner is provided as discussed above irrespective of the bondment of the foam to the shell.

Reference may be had to the above-identified copending application of Leonard E. Weiss et al., Ser. No. 502,006, for a complete description of a suitable foam release laminate 16 and method of application to the plastic liner 15. For this purpose, said application is incorporated by reference herein.

It has been found that while the foam adhesion elements 19, 20 and 21 provide a secure bond between the liner 15 and the polyurethane insulation 18 thereby preventing inward bowing of the liner 15 as a result of thermal expansion, it is an additional feature of the foam strip adhesion elements to allow for a slight degree of movement of the liner 15 relative to the insulation 18 under a stressed condition. This ability to hold the liner with a slightly flexible grip further effectively prevents a severe, potentially damaging stress build-up in the liner 15.

The use of the relatively thick strips further permits separation of the liner from the completed cabinet construction when desired by a tearing apart of the strips in effecting such removal. Thus, while the adhesion strips effectively retain the liner in mechanical secured relationship in the cabinet in normal use, they permit replacement of the liner when desired for any reason.

The foregoing disclosure of specific embodiments is illustrative of the broad inventive concepts comprehended by the invention.

Having described the invention, the embodiment of the invention in which an exclusive property or privilege is claimed are defined as follows:

1. A liner construction for use in a cabinet having insulation foamed-in-place about the outer surface of the liner, comprising: a liner formed of synthetic resin; a foam release material covering substantially the entire outer surface of the liner; and securing means attached to said foam release material at preselected positions for securing the foamed-in-place insulation to the foam release material at said preselected positions whereby said foamed-in-place insulation is effectively secured to the liner at said preselected positions.

2. The liner construction of claim 1 wherein said securing means comprises preformed elements of foam adhering material.

3. The liner construction of claim 1 wherein said securing means comprises preformed elements of open-cell polyurethane flexible foam.

4. The liner construction of claim 1 wherein said securing means comprises preformed elements of polypropylene foam.

5. The liner construction of claim 1 wherein said securing means comprises masking tape.

6. The liner construction of claim 1 wherein said securing means comprises strips of foam adhering material.

7. The liner construction of claim 1 wherein said liner defines side walls, said securing means comprising elongated elements of foam adhering material extending vertically on said side walls.

8. The liner construction of claim 1 wherein said liner defines side walls and a front opening, said securing means comprising elongated elements of foam adhering material extending vertically on said side wall adjacent said opening.

9. The liner construction of claim 1 wherein said liner defines a top wall, said securing means comprising a preformed element of foam adhering material on said top wall.

10. The liner construction of claim 1 wherein said positions are preselected to provide structural integrity to the liner.

11. A liner construction for use in a cabinet having insulation foamed-in-place about the outer surface of the liner, comprising: a liner formed of synthetic resin; a laminate sheet secured to the outer surface of the liner having an outer layer formed of foam release material; and means attached to said outer foam release layer for securing foamed-in-place insulation to preselected portions of said foam release material whereby said foamed-in-place insulation is effectively secured to the liner at said preselected positions.

12. The liner construction of claim 11 wherein said securing means comprises preformed elements secured to said laminate sheet outer layer at said preselected positions.

13. The liner construction of claim 11 wherein said securing means comprises means adapted to be torn apart in the event the liner is separated from the foamed-in-place insulation subsequent to completion of the cabinet formation.

14. The liner construction of claim 11 wherein said securing means comprises preformed elements adhesively secured to said laminate sheet outer layer at said preselected positions.

15. The liner construction of claim 11 wherein said securing means comprises preformed slightly flexible foam elements adhesively secured to said laminate sheet at said preselected positions to allow a slight degree of movement of the liner relative to the insulation to prevent damaging stress build-up in the liner material.

* * * * *